US009061863B2

(12) United States Patent
Birrer

(10) Patent No.: US 9,061,863 B2
(45) Date of Patent: Jun. 23, 2015

(54) SAFETY CIRCUIT IN AN ELEVATOR SYSTEM

(75) Inventor: Eric Birrer, Buchrain (CH)

(73) Assignee: Inventio AG, Hergiswil (CH)

( * ) Notice: Subject to any disclaimer, the term of this patent is extended or adjusted under 35 U.S.C. 154(b) by 719 days.

(21) Appl. No.: 13/499,423

(22) PCT Filed: Oct. 20, 2010

(86) PCT No.: PCT/EP2010/065823

§ 371 (c)(1),
(2), (4) Date: Mar. 30, 2012

(87) PCT Pub. No.: WO2011/054674

PCT Pub. Date: May 12, 2011

(65) Prior Publication Data

US 2012/0186914 A1 Jul. 26, 2012

(30) Foreign Application Priority Data

Oct. 26, 2009 (EP) ..... 09174017

(51) Int. Cl.
*B66B 1/34* (2006.01)
*B66B 5/00* (2006.01)
*B66B 13/22* (2006.01)

(52) U.S. Cl.
CPC ..... *B66B 5/0031* (2013.01); *B66B 13/22* (2013.01)

(58) Field of Classification Search
CPC .... B66B 5/0018; B66B 5/0031; B66B 5/021; B66B 5/0093; B66B 13/22
USPC ..... 187/247, 316, 317, 390–393; 49/26, 28, 49/120
See application file for complete search history.

(56) References Cited

U.S. PATENT DOCUMENTS

| | | | | |
|---|---|---|---|---|
| 3,961,688 | A * | 6/1976 | Maynard | 187/289 |
| 5,407,028 | A * | 4/1995 | Jamieson et al. | 187/288 |
| 5,443,142 | A * | 8/1995 | Glaser | 187/316 |
| 5,476,157 | A * | 12/1995 | Todaro | 187/280 |
| 5,549,179 | A * | 8/1996 | Herkel et al. | 187/298 |
| 6,056,088 | A * | 5/2000 | Gerstenkorn | 187/390 |
| 6,193,019 | B1 * | 2/2001 | Sirigu et al. | 187/391 |
| 6,446,760 | B1 | 9/2002 | Lisi | |

(Continued)

FOREIGN PATENT DOCUMENTS

| | | |
|---|---|---|
| CN | 1586033 A | 2/2005 |
| CN | 101353125 A | 1/2009 |

(Continued)

*Primary Examiner* — Anthony Salata
(74) *Attorney, Agent, or Firm* — Fraser Clemens Martin & Miller LLC; William J. Clemens

(57) ABSTRACT

A safety circuit in an elevator system includes at least one series connection of safety-relevant contacts that are closed during trouble-free operation of the elevator system, wherein in the case of certain operating conditions in which at least one contact is opened, the at least one contact can be bridged by semiconductor switches, and wherein the semiconductor switches are controlled by at least one processor and monitored by at least one monitoring circuit for short circuits. At least one electromechanical relay circuit, having relay contacts connected in series with the contacts of the bridged series connection can be controlled by the at least one processor and the bridgable series connection can be interrupted by the relay contacts in the case of short-circuiting of the semiconductor switches.

16 Claims, 3 Drawing Sheets

(56) References Cited

U.S. PATENT DOCUMENTS

| | | | | |
|---|---|---|---|---|
| 7,140,470 | B2 * | 11/2006 | Azpitarte | 187/317 |
| 7,401,685 | B2 * | 7/2008 | Roschier et al. | 187/391 |
| 7,503,435 | B2 * | 3/2009 | Tyni et al. | 187/391 |
| 7,575,102 | B2 * | 8/2009 | Matsuoka | 187/391 |
| 7,905,330 | B2 * | 3/2011 | Jahkonen | 187/391 |
| 7,980,363 | B2 * | 7/2011 | Kattainen et al. | 187/391 |

FOREIGN PATENT DOCUMENTS

| | | | |
|---|---|---|---|
| DE | 10133532 | A1 | 1/2003 |
| EP | 0149727 | A1 | 7/1985 |
| EP | 1535876 | A2 | 6/2005 |
| JP | 07002472 | A | 1/1995 |
| JP | 11292436 | A | 10/1999 |
| JP | 2005096881 | A | 4/2005 |
| WO | 03043167 | A1 | 5/2003 |

* cited by examiner 33c, d Resistor
34c, d Microprocessor

SAFETY CIRCUIT IN AN ELEVATOR SYSTEM

FIELD

The present invention relates to an elevator installation in which at least one elevator car and at least one counterweight are moved in opposite sense in an elevator shaft, wherein the at least one elevator car and the at least one counterweight run along guide rails and are carried by one or more support means. The or each support means is or are guided by way of a drive pulley of a drive unit which has a drive brake. Moreover, the elevator installation comprises a safety circuit which, inter alia, activates the drive brake in the case of an emergency and includes bridging-over of the door contact so that on opening of the doors the safety circuit remains closed. The present invention relates particularly to the safety circuit.

BACKGROUND

In conventional elevator installations electromechanical switches are employed for bridging over the door contacts. Particularly in the case of elevator installations in office buildings, however, the number of journeys of the elevator car can be more than 1,000 per working day, in which case bridging-over of the door contacts takes place twice in each journey. Thus, a number of approximately 520,000 switchings per year results for the electromechanical switches. This number is so high that the electromechanical switches become the principal limiting factor for the reliability of the bridging-over of the door contacts.

Due to the high number of switching actions and the high demands the bridging-over of the door contacts is classified as a so-called high-demand safety function. In general, the Standard IEC 61508 defines high-demand safety functions as functions which in disturbance-free normal operation of the elevator installation switch on average more than once per year, whereas by low-demand safety functions there are designated such functions which are provided only for emergency situations of the elevator installation or only for an emergency operation of the elevator installation, in which a disturbance is present and on average switch less frequently than once per year.

A significant element of this International Standard IEC 61508 is the determination of the safety requirement stage (Safety Integrity Level—SIL; there are SIL1 to SIL4). This is a measure for the necessary or achieved risk-reducing effectiveness of the safety functions, wherein SIL1 has the lowest demands. Provided as essential parameter for the reliability of the safety function of apparatus or installations are the calculation bases for PFH (probability of dangerous failure per hour) and PFD (probability of dangerous failure on demand). The first parameter PFH relates to high-demand systems, thus to those with a high demand rate, and the second parameter PFD to low-demand systems, the time of their service life being virtually equal to non-actuation. The SIL can be read off from these parameters.

A further definition, which can be found in technical media on the basis of this Standard (IEC 61508-4, section 3.5.12), of the low-demand mode of operation (Low-Demand Mode) and the high-demand mode of operation (High-Demand Mode or continuous operating mode) specifies the distinction thereof not on the basis of the low or high (continuous) demand rate, but in the following terms: A (low-demand) safety function, which operates in demand mode, is executed only on demand and brings the system to be monitored into a defined safe state. The executive elements of this low-demand safety function have no influence on the system to be monitored prior to occurrence of a demand for the safety function. Thereagainst, a (high-demand) safety function operating in continuous mode, always keeps the system, which is to be monitored, in its normal safe state. The elements of this high-demand safety function thus constantly monitor the system to be monitored. Failure of the elements of this (high-demand) safety function has the direct consequence of a risk if no further safety-related systems or external measures for risk reduction are effective. Moreover, a low-demand safety function is present when the demand rate is not more than once per year and not greater than twice the frequency of the routine inspection. A high-demand safety function or continuous safety function is, thereagainst, present when the demand rate is more than once per year or greater than twice the frequency of the routine inspection (see also IEC 61508-4, section 3.5.12).

SUMMARY

The object of the present invention is to propose a safety circuit for an elevator installation which embraces a more reliable and safer fulfillment of a frequently switching high-demand safety function such as, for example, the bridging-over of the door contacts and thus enhances safety, as well as also cost efficiency and minimized maintenance, of the entire elevator installation.

Fulfillment of the object consists at the outset in the selective replacement by electronic semiconductor switches of those conventional electromechanical switches which are subject to a high number of switchings (high-demand safety function). Such a high-demand safety function is, for example, the bridging-over of the door contacts, but other safety functions which are switched in disturbance-free normal operation also come into consideration and, in particular, those which are frequently switched.

Such semiconductor switches, for example with metal-oxide semiconductor field-effect transistors (MOSFET: Metal-Oxide Semiconductor Field-Effect transistor), are based generally on transistors which withstand millions of switching cycles per day. The only disadvantage is the tendency thereof to cause a short-circuit on failure, which has the consequence of a permanent bridging-over of all door contacts. In other words, if for reasons of redundancy two semiconductor switches (in order to fulfill safety category SIL2) for bridging over the door contacts are for preference provided and these two semiconductor switches should fail due to a short-circuit, the high-risk situation arises that the elevator car and the counterweight can be moved with open shaft and/or car doors, because the semiconductor short-circuit simulates closed doors.

In general, for avoidance or detection of a short-circuit in a semiconductor switch complicated and cost-intensive solutions for a so-called failsafe capability have been proposed.

The published specification EP-A2-1 535 876 discloses a drive which is connected with an electronic device having power semiconductors, wherein provided between the drive and the electronic device is at least one main contactor which is connected with a safety circuit comprising door switches connected in series. These serially connected door switches are in turn bridged over by switches on opening of the doors. This published specification thus does indeed disclose the use of semiconductors/power-semiconductors in an electronic device of the drive, but not within the safety circuit, as well as also no failsafe solution for avoidance of the tendency of semiconductors to short-circuit, but rather retention—which serves for avoidance of noise—of the at least one main contactor and checking of the latter by a time element and/or a counter.

According to the invention, in the case of a safety circuit in accordance with the present application an individual failsafe solution for the respective electronic semiconductor switches is not provided, but another electromechanical safety relay, which is present in any case, is—for the avoidance or detection of a possible short-circuit—incorporated in one of the electronic semiconductor switches. In this regard it is intended in accordance with the invention that in the case of a short-circuit in one of the electronic semiconductor switches, which according to the invention and for reasons of redundancy (safety category SIL2) are provided in double form for bridging-over of the door contacts, for the moment still nothing happens. If, however, the second electronic semiconductor switch also fails—which due to possible overload peaks can take place more rapidly—there is intervention not by an individual failsafe solution provided for that purpose or an extra safety relay provided for that purpose in order to open the safety circuit, but by at least one electromechanical safety relay which is present in any case and which would open the safety circuit within the scope of another safety function if an irregularity were to be present within this latter safety function. Alternatively, opening of the safety circuit can also take place on failure of the first semiconductor switch.

This—at least one—other electromechanical safety relay of the first safety-relevant function of the elevator installation is preferably provided for a so-called low-demand safety function, i.e. for a safety function which is exposed to few switching processes in that, for example, it switches only in the case of emergency situations outside normal operation (see the definition of Low-Demand Mode and High-Demand Mode in the above paragraphs).

According to the invention another form of safety relay can be, for example, a so-called ETSL relay circuit, wherein ETSL stands for Emergency Terminal Speed Limiting, thus for a speed-dependent emergency-situation shaft-end retardation control. Such ETSL relay circuits are known from the prior art. This ETSL relay circuit is a so-called low-demand safety component which is not used in normal operation. It comes into function only extremely rarely, namely only if the elevator car should happen to move out of its normal range. This ETSL relay circuit is electromechanical, i.e. it comprises not semiconductors, but relay contacts and electromechanical safety relays and according to the invention is, in addition to its original shaft-end retardation control function, incorporated into the monitoring of the semiconductor switches. These semiconductor switches are according to the invention used for a high-demand safety function, for example for bridging-over of the door contacts, but expressed more generally for a series connection of contacts which are closed in the case of disturbance-free normal operation, but which are opened in the case of specific operating conditions and then can be bridged over so that the entire safety circuit remains active.

In other words, the elements of the electromechanical relay circuit—or at least parts thereof—are in accordance with the invention used for the purpose of opening the safety circuit in the case of a short-circuit of one or both semiconductor switches.

According to the invention monitoring of the semiconductor switches takes place by means of a monitoring circuit which is processor-controlled. If the monitoring reveals that the semiconductor switches are short-circuited, the processor is or processors are in accordance with the invention in a position of letting the safety circuit of the elevator installation open preferably by way of another electromechanical relay circuit present in any case, for example an ETSL relay circuit.

In a first solution it is provided that at least one processor on the one hand is in a position of controlling the semiconductor switches (for example for bridging over the door contacts) and at the same time the monitoring of the semiconductor switches. On the other hand, the at least one processor is in accordance with the invention at the same time in a position, in the case of a short-circuit detected by way of the monitoring, of providing direct control intervention at relay contacts again connected in series for that purpose or at one or more electromechanical safety relays of the other electromechanical relay circuit. In other words, it is preferred in accordance with the invention that the other relay circuit itself no longer has a possible individual processor and the above-mentioned at least one processor controls not only the semiconductor switches, but also the monitoring thereof and additionally also the original function of the electromechanical relay circuit.

Consequently, in the exemplifying case of the electromechanical relay circuit detecting the ETSL function of the elevator installation this means that the ETSL function no longer has any processors or any individual processors. The at least one processor for the semiconductor switches and the monitoring thereof also takes over the ETSL function. This merely requires appropriate lines and the corresponding connection with the processor now executing both safety-relevant functions and provides a considerable cost advantage.

However, as a further alternative it is also possible to make further use of the controlling processor or processors of the electromechanical relay circuit and to pass on the controlling processor or processors of the semiconductor switches for opening the safety circuit due to a short-circuit of the semiconductor switches to the controlling processor or processors of the electromechanical relay circuit.

Moreover, it would also be possible to make further use of the controlling processor or processors of the electromechanical relay circuit not to pass on to the controlling processor or processors of the electromechanical relay circuit the control command of the processors for the semiconductor switches for opening of the safety circuit, but to let the processors of the semiconductor switches intervene directly at the relay contacts or at electromechanical safety relays connected therewith.

As already mentioned, the bridging-over of the series connection of contacts can be a frequently switching high-demand function, for example the bridging-over of the door contacts which in accordance with the invention is carried out by semiconductor switches. However, notwithstanding this use of semiconductor switches the same level of safety as with electromechanical safety relays is achieved in that in the case of a failure (short-circuit) of the bridging-over of the door contacts use is preferably made of the ETSL safety relay or relays in order to re-open the safety circuit and avoid risky situations.

In order to achieve at least the same or an increased level of safety it is basically necessary to take into consideration only those electromechanical safety relays in the incorporation, in accordance with the invention, for bypassing a bridging-over—which is no longer functional due to a short-circuit—of the door contacts by means of semiconductor switches which with respect to their connections, design and level of safety (so-called SIL category, wherein SIL stands for Safety Integrity Level, see above) are provided for a safety function which cannot be bridged over by mechanical operation, i.e. the electromechanical safety relay has to be designed so that it at least covers a safety function which is of such fundamental importance that it can be bridged over only intentionally by manual operation or even can never be bridged over.

As already mentioned, the two conventional electromechanical relays for bridging over the door contacts are in accordance with the invention replaced by, for example, two MOSFETs. Moreover, in accordance with the invention the two MOSFETs are each monitored by a respective processor or microprocessor and a monitoring circuit or check circuit in that a voltage measurement is carried out at an input and an output of the MOSFETs separately for each channel. If one MOSFET or both MOSFETs should be damaged (which in the case of such switches usually means a short-circuit) the respective processor will recognize this state and open the ETSL relay contact or contacts. A further advantage is thus that it is even possible for both MOSFETs to be damaged at the same time; in this way, however, the device or the elevator installation always remains safe.

In addition, in accordance with the invention an indicating means is provided which supplies information if a short-circuit is bypassed in one of the semiconductor switches by one of the electromechanical safety relays or the contacts thereof.

The MOSFETs are normally always closed when the doors are open. Consequently, provision is made for the respective processor to briefly open the MOSFETs at a regular interval of a few seconds in order to check the voltage drop at the MOSFET without the safety relay of the safety circuit dropping out and thus the corresponding relay contact of the safety circuit opening. This switch-off period is in accordance with the invention short enough for the purpose of measurement of the voltage drop, but not of such length as to allow the relay of the safety circuit to drop out.

It remains open to an expert to realize the just-described checking not by means of measurement of voltage drop, but by means of measurement of amperage, preferably inductively and contactlessly.

The present invention thus presents a hybrid solution which economically combines the proven safety of electromechanical relays with the high level of reliability—particularly with respect to the number of switching cycles—of transistors.

A bridging-over connection in accordance with the invention thus comprises semiconductor switches preferably for frequently switching high-demand safety functions, such as, for example, the bridging-over of the door contacts, and a processor-controlled check circuit for these semiconductor switches as well as preferably incorporation of an electromechanical safety relay, which is normally responsible for another seldom-switching low-demand safety function, for bypassing the semiconductor switches in the case of a semiconductor short-circuit and opening of the safety relay.

Moreover, the safety circuit includes the usual features and switching arrangements appropriate to current elevator installations—not least due to the applicable standards—and familiar to an expert in the field of construction of elevator installations. Such features are, for example, the serial arrangement of all shaft door contacts, the similarly serial arrangement of the car door contact or contacts, the monitoring of the travel of the elevator car by limit switches (EEC—Emergency End Contact), the monitoring of the travel speed of the elevator car by sensors at the shaft end (ETSL), brake contacts and at least one emergency off-switch.

DESCRIPTION OF THE DRAWINGS

The invention is explained in more detail symbolically and by way of example on the basis of figures. The figures are described conjunctively and generally. The same reference numerals denote the same components and reference numerals with different indices indicate functionally equivalent or similar components.

DETAILED DESCRIPTION

Figure 1:
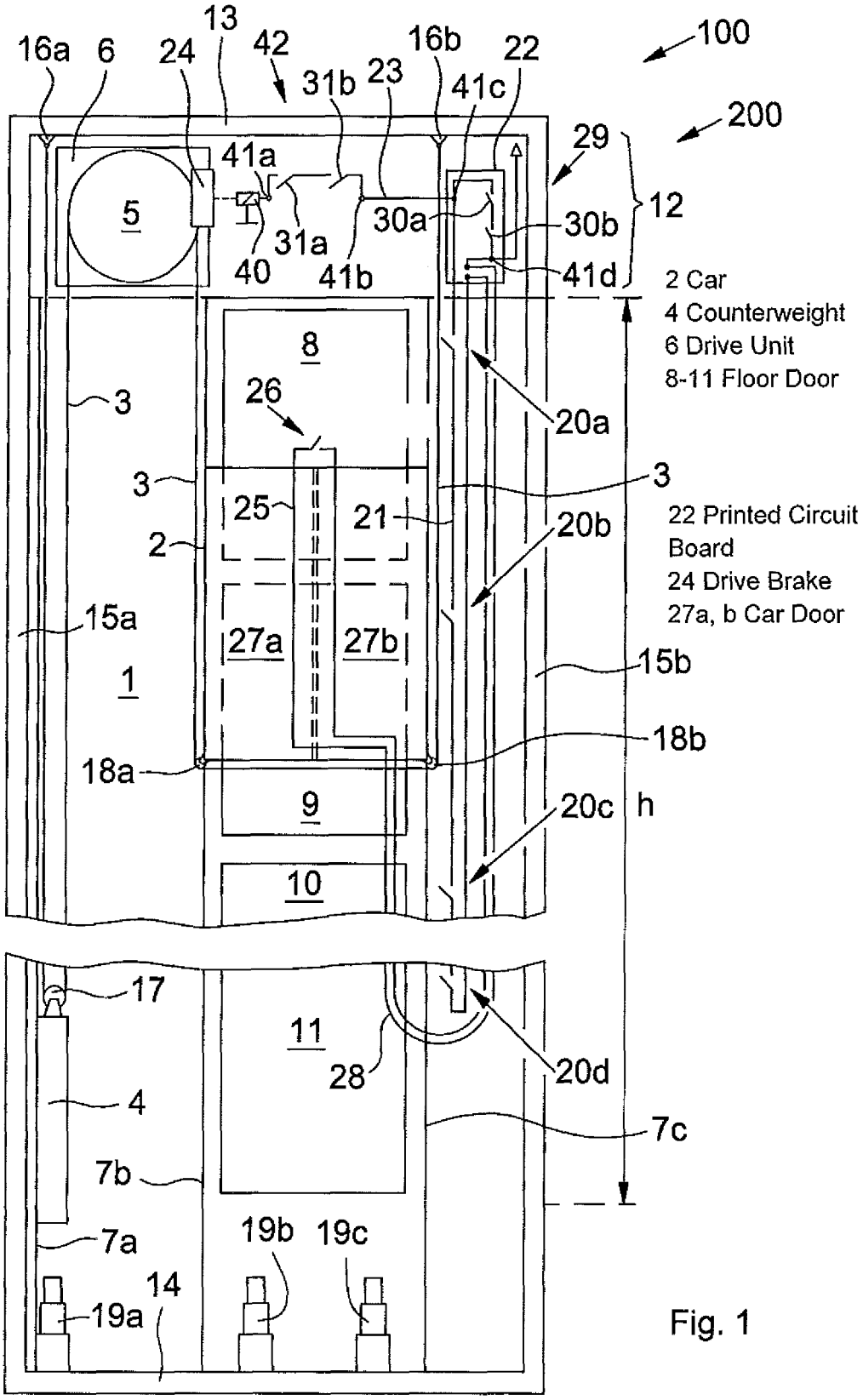
FIG. 1 shows a schematic illustration of an exemplifying elevator installation.

FIG. 1 shows an elevator installation 100, for example in illustrated 2:1 support means guidance. An elevator car 2 is movably arranged in an elevator shaft 1 and is connected by way of a support means 3 with a movable counterweight 4. In operation, the support means 3 is driven by means of a drive pulley 5 of a drive unit 6, these being arranged in, for example, the uppermost region of the elevator shaft 1 in an engine room 12. The elevator car 2 and the counterweight 4 are guided by means of guide rails 7*a* or 7*b* and 7*c* extending over the shaft height.

The elevator car 2 can at a conveying height h serve an uppermost floor with floor door 8, further floors with floor doors 9 and 10 and a lowermost floor with floor door 11. The elevator shaft 1 is formed from shaft side walls 15*a* and 15*b*, a shaft ceiling 13 and a shaft floor 14, on which a shaft floor buffer 19*a* for the counterweight 4 and two shaft floor buffers 19*b* and 19*c* for the elevator car 2 are arranged.

The support means 3 is fastened at a stationary fastening point or support means fixing point 16*a* to the shaft ceiling 13 and is guided parallelly to the shaft side wall 15*a* to a support roller 17 for the counterweight 4. From here it goes back again over the drive pulley 5 to a first deflecting or support roller 18*a* and a second deflecting or support roller 18*b*, looping under the elevator car 2, and to a second stationary fastening point or support means fixing point 16*b* at the shaft ceiling 13.

A safety circuit 200 comprises on each of the floors 8 to 11 a respective shaft door contact 20*a* to 20*d*, which contacts are arranged in series in a shaft door circuit 21. The shaft door circuit 21 is connected with a PCB (Printed Circuit Board) 22 which, for example, is arranged in the engine room 12. The PCB 22 is connected by a connection 23, which is to be understood only in symbolic terms, with the drive 6 or a drive brake 24 so that in the case of fault reports of the safety circuit 200 the drive of the drive unit 6 or the rotation of the drive pulley 5 can be stopped.

The connection 23 is to be understood only in symbolic terms because in reality it is significantly more complicated and as a rule includes the elevator control. It additionally comprises a relay 40 of the safety circuit 200 and connecting points 41*a* and 41*b*. Between the latter there is realized a shaft-end retardation control function 42, which usually has two channels in order to fulfill the safety category SIL2, in that a first ETSL channel and a second ETSL channel are serially arranged in the safety circuit 200. The two ETSL channels are symbolically illustrated as switches 31*a* and 31*b*, but are switching relays with switch contacts.

Not only the shaft doors have a shaft door circuit 21 for control of the opening of the shaft doors 21, but in addition the elevator car 2 has a car door circuit 25 for control of the opening of two schematically indicated car sliding doors 27*a* and 27*b*. This car door circuit 25 comprises a car door contact 26. Signals from the car door circuit 25 are conducted by way of a hanging cable 28 of the elevator car 2 to the PCB 22, where they are included in the safety circuit 200 in series with the shaft door contacts 20*a* to 20*d*.

The elevator installation 100 further comprises a bridging-over connection 29 for the shaft door contacts 20*a* to 20*d* arranged in a series connection 43 and the similarly serially arranged car door contact 26. The bridging-over connection 29 comprises switching relays which are arranged in parallel between two further connecting points 41*c* and 41*d* and the switch contacts of which are symbolically illustrated as switches 30*a* and 30*b*.

Figure 1A:
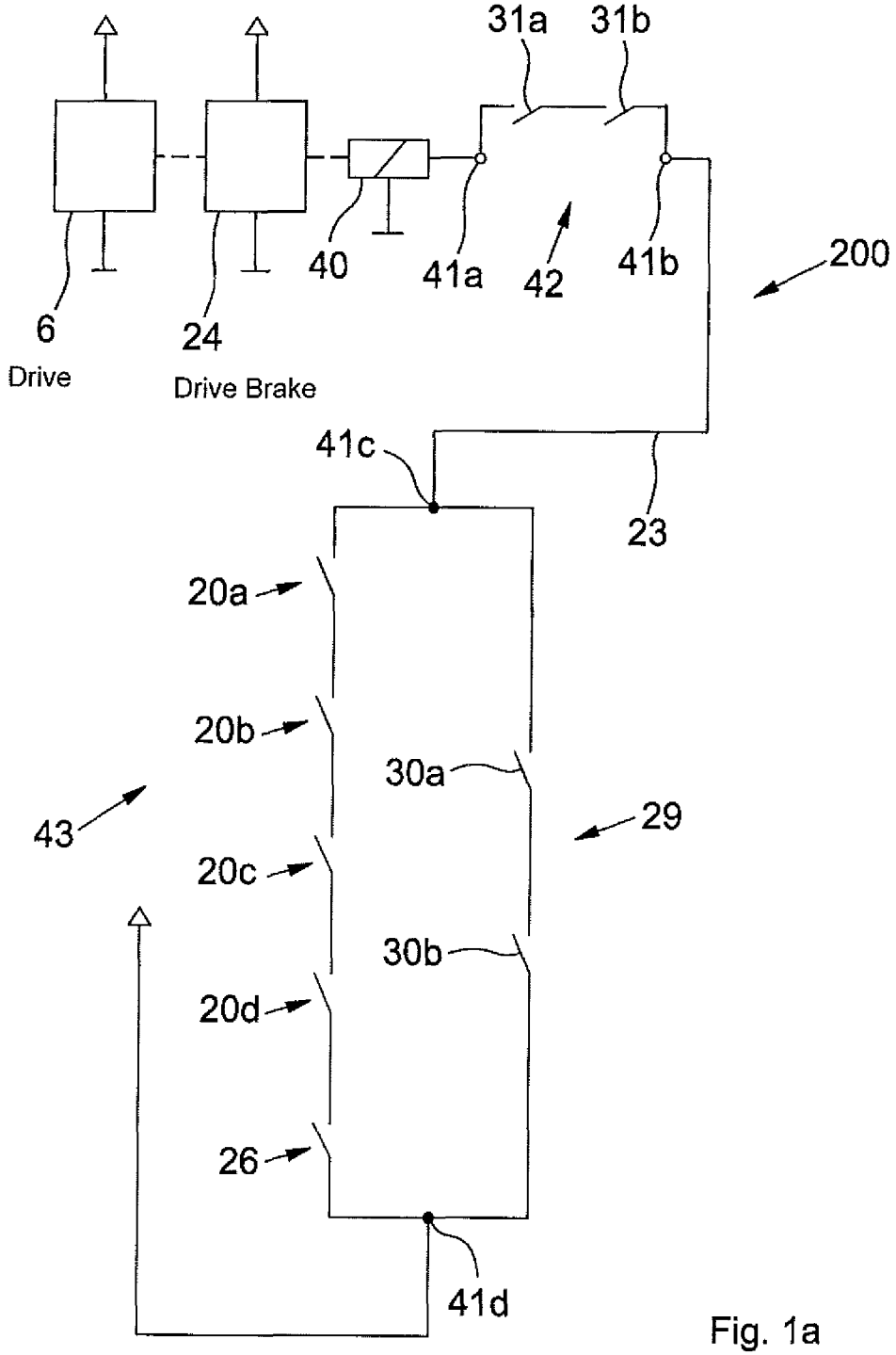
FIG. 1*a* shows a schematic illustration of the safety circuit of FIG. 1.

In FIG. 1*a* the safety circuit 200 of the elevator installation 100 of FIG. 1 is illustrated separately so that the connections and switchings thereof are clearer. The shaft-end retardation control connection 42 and the door-contact bridging-over connection 29 are independent of one another; they are merely serially integrated in the safety circuit 200.

Figure 2:
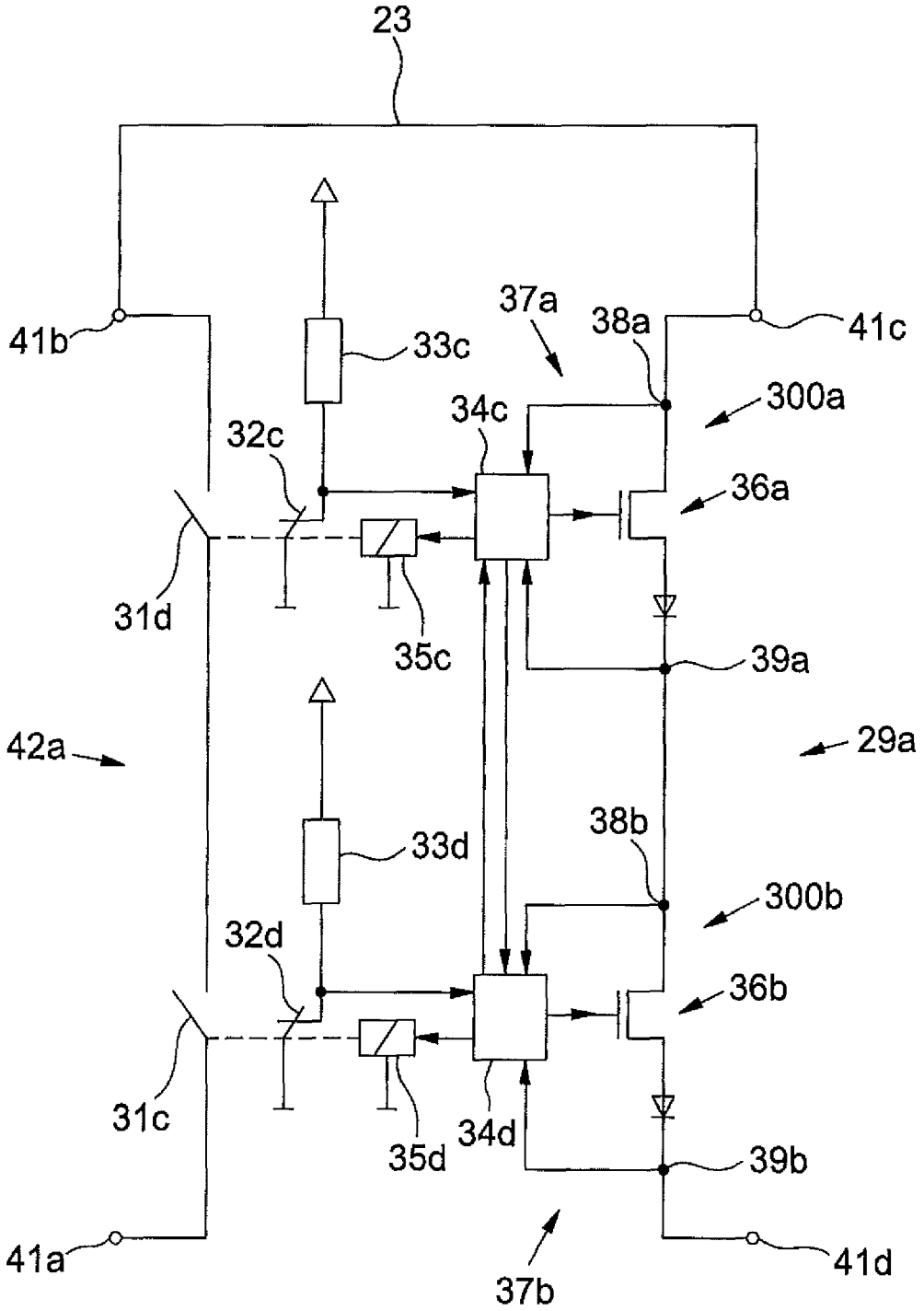
FIG. 2 shows a schematic illustration of an arrangement in accordance with the invention of two semiconductor switches for bridging over a series connection of contacts, a monitoring circuit for these two semiconductor switches, an electromechanical relay circuit and the integration in accordance with the invention of this arrangement in a conventional safety circuit according to FIG. 1 or FIG. 1*a* and the thus-resulting safety circuit according to the invention.

In FIG. 2 it is illustrated how on the one hand a bridging-over connection 29*a* according to the invention for bridging over the contacts 20*a* to 20*d* and 26 of FIGS. 1 and 1*a* is executed between the connecting points 41*c* and 41*d* of the safety circuit 200 of FIG. 1 and how on the other hand an electromechanical relay circuit 42*a* is arranged in accordance with the invention between the connecting points 41*a* and 41*b* of the safety circuit 200 of FIG. 1, as well as how the bridging-over connection 29*a* and the electromechanical relay circuit 42*a* are in accordance with the invention connected together and thus a safety circuit 200 according to the invention and an elevator installation 100 according to the invention result. The electromechanical relay circuit 42*a* is preferably represented by a relay circuit for performance of a low-demand safety function of the elevator installation 100.

In order to take over a high-demand safety function such as, for example, the bridging-over function of the door contacts a microprocessor 34*c* with a semiconductor switch or transistor 36*a* is appropriately connected into a first circuit 300*a*. The transistor 36*a* is by way of example represented as MOSFET transistor, but other types of transistors are also suitable.

Also indicated is a monitoring circuit 37*a* which is connected with an input 38*a* and an output 39*a* of the semiconductor switch 36*a*. The processor 34*c* controls the periodic cycles of measurement of the voltage or amperage at the input 38*a* and output 39*a*. The connecting point 38*a* can obviously also be represented by the output of the semiconductor switch 36*a* and the connecting point 39*a* by the input of the semiconductor switch 36*a*.

The bridging-over connection 29*a*, with which—as apparent from FIGS. 1 and 1*a*—all door contacts 20*a* to 20*d*, 26 are serially connected by way of the connecting points 41*c* and 41*d*, is of two-channel construction for reasons of redundancy or fulfillment of the SIL2 safety category. The second channel comprises, analogously to the first channel, a circuit 300*b*, a semiconductor switch 36*b* and a monitoring circuit 37*b* for the semiconductor switch 36*b*, which is connected with an input 38*b* and an output 39*b* of the semiconductor switch 36*b* and is controlled by a microprocessor 34*d*. The microprocessors 34*c* and 34*d* are connected together for a bidirectional signal exchange. It is also possible to provide more than two channels.

The microprocessor 34*c* is additionally connected with an electromechanical relay 35*c*, a change contact 32*c* and a resistance 33*c* of a first ETSL channel or, with omission of a possible ETSL processor, the remaining elements of an electromechanical relay circuit 42*a* with relay contacts 31*c* and 31*d*. The microprocessor 34*d* is in turn connected with an electromechanical relay 35*d*, a change contact 32*d* and a resistance 33*d* of a second ETSL channel. These two ETSL channels guarantee the shaft-end retardation control function, which is thus to SIL2 safety category, wherein the retardation control connection 42 necessary for that purpose is connected between the connecting points 41*a* and 41*b* of the safety circuit 200 of FIG. 1.

The shaft-end retardation control connection 42 used for the purpose according to the invention no longer has individual microprocessors, because the control of the retardation control connection 42 is carried out by means of the microprocessors 34*c* and 34*d*, in addition to the control of the bridging-over connection 29*a* and in addition to the control of the monitoring circuits 37*a* and 37*b*.

Also optionally possible is an arrangement with a single microprocessor which controls not only the two illustrated channels of the bridging-over connection 29*a*, but also the two illustrated channels of the electromechanical relay circuit 42*a* and the retardation control connection 42.

FIG. 2 schematically illustrates an exemplifying arrangement of a parallelly arranged two-channel bridging-over of door contacts connected in series (not only the shaft door contacts 20*a* to 20*d*, but also the car door contact 26) of the elevator installation 100*a*, or in general a possible combined detection in accordance with the invention of a first safety-relevant function, preferably a low-demand safety function (for example the shaft-end retardation control ETSL) and a further safety-relevant function, preferably a high-demand safety function (for example the bridging-over of the door contacts).

If a check of the semiconductor switches 36*a* and 36*b* by means of the monitoring circuits 37*a* and 37*b* yields a defect or a short-circuit of one of the semiconductor switches 36*a* and 36*b* or both semiconductor switches 36*a* and 36*b* the microprocessor and/or microprocessors 34*c* and/or 34*d* is or are according to the invention in a position of controlling the conventional electromechanical safety relays 35*c* and 35*d* of the electromechanical relay circuit 42*a* for opening of the safety circuit 200. This takes place additionally to the intended original shaft-end retardation of the elevator car 2, which the electromechanical relay circuit 42*a* could originally exercise. This intended original safety function does not cease to apply due to the assumption of the opening function of the safety circuit 200, preferably because the microprocessors 34*c* and 34*d* control not only the shaft-end retardation control connection of the elevator car 2 of the elevator installation 100, but also the bridging-over connection 29*a* with the semiconductor switches 36*a* and 36*b* as well as monitoring of the semiconductor switches 36*a* and 36*b*.

The bridging-over connection 29*a* equipped with the semiconductor switches 36*a* and 36*b* comes into consideration not only for frequently switching high-demand functions, but also for any low-demand functions such as, for example, the EEC function, wherein EEC stands for Emergency End Contact, thus for a travel limitation of the elevator car 2 by means of limit switches beyond its normal travel path. The bridging-over connection 29*a*, which according to the invention can be combined with an electromechanical relay circuit 42*a* as disclosed, is also used, for example, for the braking function or for emergency evacuation.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A safety circuit in an elevator installation with at least one series connection of safety-relevant contacts which are closed during disturbance-free operation of the elevator installation, comprising:

at least one semiconductor switch connected to bridge over at least one of the safety-relevant contacts in response to specific operating conditions in which the at least one safety-relevant contact is opened;

a processor controlling the at least one semiconductor switch;

a monitoring circuit connected to the at least one semiconductor switch and the processor for monitoring for a short-circuit of the at least one semiconductor switch; and an electromechanical relay circuit with at least one relay contact connected in series with the safety-relevant contacts wherein the relay circuit is controlled by the processor to interrupt the series connection by the at least one relay contact in response to a short-circuit of the at least one semiconductor switch detected by the monitoring circuit.

2. The safety circuit according to claim 1 wherein the processor controls a further safety-relevant control connection to interrupt the series connection by the relay circuit.

3. The safety circuit according to claim 1 wherein the at least one semiconductor switch is metal-oxide semiconductor field-effect transistor.

4. The safety circuit according to claim 1 wherein a voltage at an input and an output of the at least one semiconductor switch is measured in the monitoring circuit to monitor for a short-circuit.

5. The safety circuit according to claim 1 wherein an amperage at an input and an output of the at least one semiconductor switch is measured in the monitoring circuit to monitor for a short-circuit.

6. The safety circuit according to claim 1 wherein an indication of bypassing of a short-circuit in the at least one semiconductor switch is indicated by the at least one relay contact.

7. An elevator installation having at least one safety circuit according to claim 1.

8. A method of monitoring the at least one semiconductor switch in the elevator installation according to claim 1, comprising the following steps:

a) periodically measuring a voltage or an amperage at an input and at an output of the at least one semiconductor switch; and b) opening the series connection of the safety circuit by the at least one relay contact if the measurement according to step a) indicates a short-circuit of the at least one semiconductor switch.

9. A method of using semiconductor switches for bridging over safety-relevant contacts in a series connection in an elevator installation, comprising: in response to a short-circuit of at least one of the semiconductor switches, interrupting the series connection by operation of an electromechanical relay circuit with relay contacts.

10. The use according to claim 9 including using the relay circuit for a further control connection and in case of impermissible operational states of the elevator installation, interrupting the series connection with the relay contacts of the relay circuit.

11. A safety circuit in an elevator installation with a series connection of safety-relevant contacts which are closed during disturbance-free operation of the elevator installation, comprising;

a pair of semiconductor switches connected to bridge over the safety-relevant contacts in response to specific operating conditions in which at least one of the safety-relevant contacts is opened;

at least one processor controlling the semiconductor switches;

a monitoring circuit connected to each of the semiconductor switches and the at least one processor for monitoring for a short-circuit of each of the semiconductor switches; and an electromechanical relay circuit with at least one relay contact connected in series with the safety-relevant contacts wherein the relay circuit is controlled by the at least one processor to interrupt the series connection by the at least one relay contact in response to a short-circuit of either of the semiconductor switches detected by the monitoring circuit.

12. The safety circuit according to claim 11 wherein the at least one processor controls a further safety-relevant control connection to interrupt the series connection by the relay circuit.

13. The safety circuit according to claim 11 wherein the semiconductor switches are metal-oxide semiconductor field-effect transistors.

14. The safety circuit according to claim 11 wherein a voltage at an input and an output of each of the semiconductor switches is measured in the monitoring circuit to monitor for a short-circuit.

15. The safety circuit according to claim 11 wherein an amperage at an input and an output of each of the semiconductor switches is measured in the monitoring circuit to monitor for a short-circuit.

16. The safety circuit according to claim 11 wherein an indication of bypassing of a short-circuit in each of the semiconductor switches is indicated by the at least one relay contact.

* * * * *